United States Patent [19]

Otters

[11] Patent Number: 4,489,554

[45] Date of Patent: Dec. 25, 1984

[54] VARIABLE CYCLE STIRLING ENGINE AND GAS LEAKAGE CONTROL SYSTEM THEREFOR

[76] Inventor: John Otters, 11317 Miller Rd., Whittier, Calif. 90604

[21] Appl. No.: 396,606

[22] Filed: Jul. 9, 1982

[51] Int. Cl.[3] ..... F02G 1/04; F02G 1/06

[52] U.S. Cl. ..... 60/518; 60/520; 60/517

[58] Field of Search ..... 60/517, 518, 519, 520, 60/526

[56] References Cited

U.S. PATENT DOCUMENTS

| | | | |
|---|---|---|---|
| Re. 30,176 | 12/1979 | Beale | 60/520 |
| 3,487,635 | 1/1970 | Prast et al. | 60/520 |
| 3,828,558 | 8/1974 | Beale | 60/520 |
| 3,848,877 | 11/1974 | Bengtsson et al. | 60/517 X |
| 3,986,360 | 10/1976 | Hagen et al. | 60/520 |
| 4,215,548 | 8/1980 | Beremand | 60/520 |
| 4,353,683 | 10/1982 | Clark | 60/517 |

*Primary Examiner*—Allen M. Ostrager

*Attorney, Agent, or Firm*—Beehler, Pavitt, Siegemund, Jagger & Martella

[57] ABSTRACT

An improved thermal engine of the type having a displacer body movable between the hot end and the cold end of a chamber for subjecting a fluid within that chamber to a thermodynamic cycle and having a work piston driven by the fluid for deriving a useful work output. The work piston pumps a hydraulic fluid and a hydraulic control valve is connected in line with the hydraulic output conduit such that the flow of hydraulic fluid may be restricted to any desired degree or stopped altogether. The work piston can therefore be controlled by means of a controller device independently from the movement of the displacer such that a variety of engine cycles can be obtained for optimum engine efficiency under varying load conditions. While a Stirling engine cycle is particularly contemplated, other engine cycles may be obtained by controlling the movement of the displacer and work pistons. Also disclosed are a working gas recovery system for controlling leakage of working gas from the displacer chamber, and a compound work piston arrangement for preventing leakage of hydraulic fluid around the work piston into the displacer chamber.

45 Claims, 11 Drawing Figures

EXTERNAL HYDRAULIC SYSTEM
HYDRAULIC SPRING
AIR
AIR-FUEL MIXING SYSTEM
SUPPLY TANK
EXHAUST
B.D.C.
T.D.C.
(TO 33)
TO 128

32
109
133
125
91
91a
99
34
94
74
30
98a
39
45
98
74b
74a
37
53
31
96
51
72
95
122
TO 67
49
128
160
126
124
123
87
70

III
IV
II
I
PRESSURE
VOLUME

II
I
T.D.C.
COOLING
HEATING
III
IV
B.D.C.
DISPLACER PISTON POSITION
T.D.C.
B.D.C.
(WORK) POWER PISTON POSITION 15
24
17
80
88
86
10
26
40
78
114
108
106
56
64
102
104
110
112
65
100
TO HYDRAULIC SPRING AND/OR TO HYDRAULIC ACCUMULATOR & TANK

VARIABLE CYCLE STIRLING ENGINE AND GAS LEAKAGE CONTROL SYSTEM THEREFOR

BACKGROUND OF THE INVENTION

1. Field of the Invention

The present invention pertains generally to the field of external combustion engines and more particularly relates to a thermal engine of the Stirling type having independently movable displacer and working pistons and provided with means for controlling the motion of the displacer piston and working piston independently of one another to thereby optimize the work output of the engine. The invention further relates to a compound work piston for isolating the working gas chamber from contamination by hydraulic fluid and a recovery and feedback system for preventing leakage of working gas into the atmosphere by mixing the gas with air and combusting the mixture in the engine burner.

2. State of the Prior Art

Thermal engines of the Stirling type have been known for many years and many variations and improvements on the basic engine design have been conceived. Basically, the Stirling type engine is an external combustion engine which includes a working fluid sealed in a pressurized chamber which has a hot end and a cold end. A displacer body is movable within the chamber but occupies only a portion of the chamber volume so that as the displacer body is moved towards the cold end of the chamber the fluid is displaced towards the remaining volume at the hot end of the chamber. Cooling of the fluid is achieved by opposite movement of the displacer body towards the hot end, thus forcing the fluid towards the cool end of the chamber. In this manner the fluid is subjected to a thermodynamic cycle responsive to movement of the displacer body. The hot end of the chamber is externally heated by any means desired or available, including gas burners, solar heaters, etc. The cold end of the fluid chamber may be water or air cooled, among other possible refrigeration schemes. The pressurized fluid is allowed to exert force against and reciprocate a working piston from which a useful work output may be derived through mechanical shaft arrangements or the like.

An ideal Stirling cycle can be plotted in a pressure volume (PV) diagram by a pair of isothermal expansion-compression curves connected by a pair of constant volume heating and cooling lines. In practical engines, however, such an ideal cycle has never been achieved due to a dependent interaction between the displacer piston and to power piston of the engine. As a result of this interaction, the real cycle achieved in practical engines is more closely represented by an ellipsoid contained within the ideal PV representation of the Stirling cycle. This is because the isothermal expansion and contraction and the constant volume heating and cooling phases are not allowed to come to completion before the following phase must begin, due to the interrelated movement between the displacer and power pistons. An amount of work, therefore, represented by the difference in area between the ideal PV cycle representation and the ellipsoid representative of the practical cycle is lost. This quantity of work is largely contained in the four corners of the ideal PV diagram which are cut off in the real cycle.

In addition, even if an ideal cycle could be achieved by first moving the displacer to obtain a constant volume heating or cooling while keeping the power piston in a stationary position, and then releasing the power piston after the constant volume phase is completed to obtain the constant temperature expansion and compression, and so on, this would still not result in a maximum work output in a practical engine. This is due to the fact that the ideal cycle it is assumed that heat enters and leaves the working fluid through an ideal cylinder wall surrounding the pressurized fluid chamber. In reality, of course, such ideal heat transfer does not take place, but instead regenerative devices are used to remove and return heat to the working fluid as it passes through a heater-regenerator-cooler structure. There is therefore a certain amount of thermal inertia or lag between the heat transfer into and out of the working fluid relative to the movement of the displacer piston. Thus, an optimal Stirling cycle in a practical engine is not identical with the ideal Stirling cycle.

The ideal Stirling cycle in a theoretical engine may be correlated to actual movement of the displacer and power pistons to arrive at an equivalent piston motion diagram. An ideal Stirling cycle clearly would require that the power piston come to a complete stop during the constant volume portions of the cycle. Similarly, the isothermal compression and expansion strokes could be accomplished by movement of the power piston without moving the displacer piston. The ideal Stirling cycle is then seen as a four-step process, each step involving movement of one of the two pistons, while the other piston is held stationary.

In a real engine, heat is not transferred into and out of the fluid through the cylinder walls during the isothermal processes. Instead, heating and cooling of the working fluid must be accomplished by suitable movement of the displacer piston. Recognizing this inherent characteristic of the engine, a more realistic picture of the piston motion required to produce the ideal Stirling cycle differs from the just-described four-step process. The derivation of an ideal piston motion diagram for an ideal Stirling cycle when motion of the displacer piston must be taken into consideration in a real engine is described at page 673, first column, first paragraph, SAE Transactions, Volume 68, 1960. The referenced page is part of an article entitled "GMR Stirling Thermal Engine, Part of the Stirling Engine Story—1960 Chapter", by Gregory Flynn, Jr., Worth H, Percival, and F. Earl Heffner, Research Laboratories, General Motors Corporation, which article is incorporated herein by this reference as though fully set out as part of this disclosure.

To quote the referenced paragraph, and with reference to FIGS. 2 and 3 of the drawings.

"It is possible to construct an ideal piston motion diagram from the ideal PV diagram of the cycle. The first, isothermal compression, process must be accomplished by movement of the power piston from bdc to tdc to reduce the volume of the fluid and by an upward movement of the displacer piston to provide cooling equivalent to the work of compression performed by the lower piston. Thus, the displacer piston cannot be at tdc at point I, but must rise from some lower position to tdc during the compression process. The second, constant volume heating, process from II and III can be accomplished with movement of only the displacer piston, but it cannot move the full stroke to bdc since heating must also be done during the isothermal expansion stroke from III to IV. After the constant volume heating process, the isothermal expansion is accomplished by moving the power piston from tdc to bdc while the displacer piston finishes its travel to bdc. The final process is the constant volume cooling from IV to I, and this may be accomplished by motion of the displacer alone."

The complete piston motion diagram for the ideal cycle is then as shown in FIG. 3 of the drawings. It is evident that in order to approximate such ideal piston movement, it will be necessary to bring the power piston to a complete stop for portions of the cycle. Until now, this has been considered to be impractical in any reasonable engine mechanism, and all known practical Stirling engines thus operate along cycles in which the vertical lines corresponding to the constant volume portions of the cycle have been eliminated and the complete cycle approximates an ovaloid line in a PV diagram as well as in piston motion diagrams wherein the displacer piston is plotted on the ordinate as a function of the position of the power piston as the abscissa.

It follows from the above that an increased power output and improved efficiency would be obtainable if the piston motion for a given engine more closely approximated the ideal piston motion diagram explained above and illustrated in FIG. 3 of the attached drawings and in the incorporated article.

It is therefore an object of the present invention to disclose an improved Stirling engine including means for controlling the movement of both the displacer and the power piston independently of one another in such a manner as to closely approximate or achieve ideal piston motion.

It is a further object of this invention to disclose an improved Stirling engine incorporating means for bringing the power piston to a complete stop during portions of the thermodynamic cycle of the engine.

It is yet another object of this invention to disclose an improved Stirling engine wherein the relative motion of the power piston and the displacer piston may be adjusted to achieve variable operating cycles for a given engine.

Attempts have been made in the past to control the motion of the displacer piston in order to more closely approximate an ideal engine cycle. The applicant is aware of the following patents representative of such attempts:

Beremand, U.S. Pat. No. 4,215,548, Aug. 5, 1980
Prast et al, U.S. Pat No. 3,487,635, Jan. 6, 1970
Beale, U.S. Pat. No. 3,552,120, Jan. 5, 1971
Benson, U.S. Pat. No. 4,044,558, Aug. 30, 1977

Additional patents known to the applicant and generally relating to thermal engines include the following:

Cooke-Yarborough, U.S. Pat. No. 4,077,216, Mar. 7, 1978
Finkelstein, U.S. Pat. No. 4,199,945, Apr. 29, 1980
Schuman, U.S. Pat. No. 3,782,859, Jan. 1, 1974
Spriggs, U.S. Pat. No. 3,830,059, Aug. 20, 1974
Mulder, U.S. Pat. No. 4,188,791, Feb. 19, 1980
Schuman, U.S. Pat. No. 4,132,505, Jan. 2, 1979
Schuman, U.S. Pat. No. 4,072,010, Feb. 7, 1978

The Beremand patent discloses a free piston regenerative engine constructed for a hydraulic output and includes a displacer piston which is driven by external means to circulate the working fluid through a heater, regenerator and cooler. The displacer piston may be moved between thee hot end and cool end of the working gas chamber by pneumatic means or electromagnetic coils. The displacer body can therefore be controlled to move in a desired manner in order to optimize the operating cycle of this engine. As illustrated in FIG. 6 of this reference, an attempt is made to approximate an ideal operating cycle for a Stirling type engine. No suggestion is offered, however, for varying the phase or stroke of the power piston in addition to controlling the movement of the displacer for maximum engine efficiency. Clearly, by controlling the displacer piston alone it is only possible to improve somewhat on the engine's efficiency but optimum operation requires independent control over both pistons.

The Prast et al disclosure teaches a thermal engine wherein, as stated in its abstract, a displacer piston is controlled by means of an energy dissipating device. The energy dissipating device may comprise a damper piston connected to the displacer piston and moving within a fluid filled piston cylinder. A valve is provided for restricting fluid flow in a passage connecting the opposite ends of the cylinder between which moves the damper piston. Various embodiments of the energy dissipating scheme are illustrated for the several engine structures shown, all of which, however, differ from the engine contemplated by the present invention. Each of the illustrated embodiments includes a compressor piston 1 or 101 which is not controlled relative to the displacer/expansion piston.

The Beale reference teaches a system for adjusting the stroke length of the displacer pistons to thereby vary the power output of the engine. However, no device for controlling the relative movement of the power pistons is shown.

A further problem inherent in many types of Stirling engine designs is the leakage of the working gases from the displacer chamber past the work piston, as well as contamination of the working gas by hydraulic fluid leaking around the work piston into the displacer chamber. Many attempts have been made to solve this problem including elaborate piston seal structures, gas recirculation schemes and even replacement of the gaseous working substance by a non-compressible liquid or solid. Representative of such attempts are the following patents.

Sugahara, U.S. Pat. No. 4,093,239 June 6, 1978
Asano, U.S. Pat. No. 4,197,707 Apr. 15, 1980
Hefner et al, U.S. Pat. No. 3,568,436 Feb. 3, 1969
Rosenqvist, U.S. Pat. No. 4,195,554 Apr. 1, 1980
Neelen, U.S. 3,667,348 June 6, 1972
Negishi, U.S. Pat. No. 4,222,239 Sept. 16, 1980

In practice these proposed solutions have fallen short of the required performance due to wear of the parts at high engine speeds, excessive cost or complexity of construction. A continuing need exists, therefore, for a reliable and relatively simple solution to the problem of working gas leakage from the displacer chamber.

In prior engines, leakage of both hydraulic fluid or working gas around the working piston have been a source of continuing difficulty due to the resulting contamination of the working gas or hydraulic fluid. For example, where oxygen or air is used as the working gas, leakage gas may oxidize hydraulic fluid or oil lubricating the working piston, creating a sludge which in turn contaminates the working-gas and eventually can work its way into the regenerator, clogging the fine passages therein. If unchecked this process will eventually stop the engine. Leakage of gas into the hydraulic system may cause emulsification of the liquid which would make the oil or hydraulic fluid "spongy" or compressible, decreasing efficiency of the system.

SUMMARY OF THE INVENTION

The present invention, therefore, is directed at improvements in thermal engines of the type having a displacer body movable between the hot end and the cold end of a chamber for subjecting a fluid within said chamber to a thermodynamic cycle and having a power or work piston driven by the fluid for deriving a useful work output. More specifically, the improvements comprise means for controlling the movement of the displacer piston and means for controlling the reciprocal movement of the power piston to obtain variable phase relationships between the displacer piston and the power piston. The invention further comprises means for locking the power piston in a stationary position during certain phases of the engine cycle. In addition, the invention contemplates means for variably adjusting the relative movements of the displacer and power pistons for a given engine to vary the efficiency and work output of the engine as may be desired depending on the energy input to the engine and required work output at a given time.

In a preferred embodiment of the invention the engine comprises an engine housing defining a displacer chamber within which a displacer body is freely movable, a work cylinder bore in communication with the displacer chamber, and a work piston reciprocable within the work piston bore between a top position and a bottom position. The bottom of the work piston cylinder is connected to a source of hydraulic fluid, which fluid fills the cylinder on the bottom side of the work piston. The top end of the work piston bore is in communication with the working fluid filling the displacer chamber. In a preferred embodiment, the displacer chamber is cylindrical and coaxially aligned with the bore of the work cylinder, and the work piston bore communicates with the cold end of the displacer cylinder, while the opposite, hot end of the displacer cylinder is externally heated, as by a gas combustor.

The displacer piston may be a lightweight metallic or ceramic cylindrical shell of hollow construction so as to be easily movable between the hot and cold ends of the displacer bore and provided with internally mounted magnets such as small permanent bar magnets of a material capable of remaining magnetized at the relatively high engine temperatures. Preferably, the magnets are mounted on the end of the displacer piston which is oriented towards the cool end of the displacer piston cylinder. In the alternative, a magnetically permeable material may be included in the displacer, in which a magnetic field may be induced by external magnetic coils. One or more electromagnetic induction coils may be wound coaxially around the displacer bore. Preferably, one such coil is proximate the cool end of the displacer bore while another coil is nearer to the hot end. Electrical currents may be passed through the coils to create magnetic fields which will operate on the magnets in the displacer piston to cause the displacer to move between the two ends of the displacer bore. The rate of movement of the displacer is fully adjustable by varying the intensity of the current through the coils and the displacer may also be held stationary at one or the other end of the displacer bore by a steady current through the coils, or by a mechanical detent device to conserve electrical current. It follows that during a given displacer piston stroke, the displacer piston may also undergo acceleration and deceleration at various points during the stroke to obtain any desired heat transfer curve to and from the working fluid in the displacer chamber. As the displacer moves between the two ends of the displacer bore, the fluid therein is forced through a heater-regenerator-cooler structure wherein heat is removed from or added to the working fluid. The working fluid when heated expands to push against the power piston and cause the power piston to operate in compression against the hydraulic or pneumatic fluid filling the bottom side of the work piston bore. The hydraulic fluid is thereby forced out of the work piston bore and directed through suitable conduits into a hydraulic accumulator where fluid pressure may be built up and stored for future use. As the working fluid in the displacer chamber is subsequently cooled responsive to movement of the displacer from the cool end to the hot end of the displacer bore, the work piston is returned to its top position by spring means which may be liquid, gas, mechanical or a combination thereof. The lower piston thus returns to its initial top position and in the process draws fresh hydraulic fluid from an external reservoir into the bottom of the work piston.

A variable flow control valve of electromechanical construction may be placed in either the inlet conduit carrying fresh hydraulic fluid from the reservoir into the power piston bore or the outlet conduit carrying the compressed output fluid, or there may be a single conduit serving both purposes such that the valve controls both inflow and outflow of fluid. In the alternative, the flow control valve may be associated with a liquid spring which returns the work piston towards its top position. In such an alternate embodiment of the invention, the control valve may be connected for controlling the flow of spring fluid between a fluid reservoir and the liquid spring space as the liquid is pumped into and drawn from the reservoir by the working piston. The flow control valve may be closed for positively locking the power piston at any point in its stroke. This follows since the hydraulic fluid flowing through the valve may be selected to be substantially incompressible. Preferably, the flow control valve has a continuously adjustable variable aperture such that the flow rate of the hydraulic fluid into or out of the power cylinder bore is continuously variable and consequently the rate of movement of the power piston is fully controllable both in the compression and expansion strokes.

By providing suitable control circuitry to operate the flow control valve, the power piston may be accelerated or slowed at various points along its stroke to thereby enable complete flexibility and control over the engine operating cycle. In this manner, the relative motion of the displacer and power pistons can be fully controlled and made to closely approximate ideal piston motion for maximum engine efficiency. By removing all mechanical interconnections between the displacer and power pistons, it is then possible to fine-tune the engine operating cycle to the particular heat transfer characteristics of the heater-regenerator-cooler assembly and to vary the engine operation to suit momentary variations in the load imposed on engine output. In particular, the phase relationship of the work piston and displacer can be altered to provide an optimum operating cycle under varying engine operating conditions. Thus, the engine operation may be adjusted to meet varying torque/speed requirements, thereby eliminating the need for transmission devices. Similarly, it is possible to adjust the engine operating cycle for different levels of energy or heat input into the engine as, for example, when the engine is operated by a solar energy source which varies in intensity through the day.

While in the preferred embodiment of the invention the displacer is electromagnetically activated and the power piston provides a hydraulic output, other forms of controlling the motion of both the displacer piston and work piston are also contemplated. Specifically, the displacer piston may be controlled by pneumatic or hydraulic means instead of the electromagnetic means illustrated in the drawings and the power piston may be controlled by electromagnets in a manner similar to that of the displacer piston, it being understood that a far greater amount of current will be required to generate the necessary magnetic fields for controlling the power piston against the large pressures operating against the same.

The invention further comprises a compound work piston arrangement in which a separate hydraulic piston is linked to the working piston by means of a linkage or connecting rod extending through a bore of reduced diameter which can be more readily sealed against leakage of working gas than the circumference of the working piston itself.

A working gas recovery system is also shown for controlling leakage of working gas from the displacer chamber by combusting the gas in the engine burner. In one embodiment of the invention, working gas drawn from the displacer chamber and mixed with air is the main fuel supply for the engine burner.

The working gas recovery system may include a pump arrangement integral with the compound work piston structure for admixing air to the recovered gas to obtain a readily combustible fuel mixture. The pump arrangement may be further designed to cushion the work piston on its return stroke and return a portion of the kinetic energy of the work piston to heat which is used to preheat the gas-air mixture for more efficient combustion in the burner. In the absence of such cushioning, this kinetic energy would be uselessly dissipated by heating the hydraulic spring fluid and the hydraulic control valve.

DETAILED DESCRIPTION OF A PREFERRED EMBODIMENT OF THE INVENTION

Figures 1, 1B:
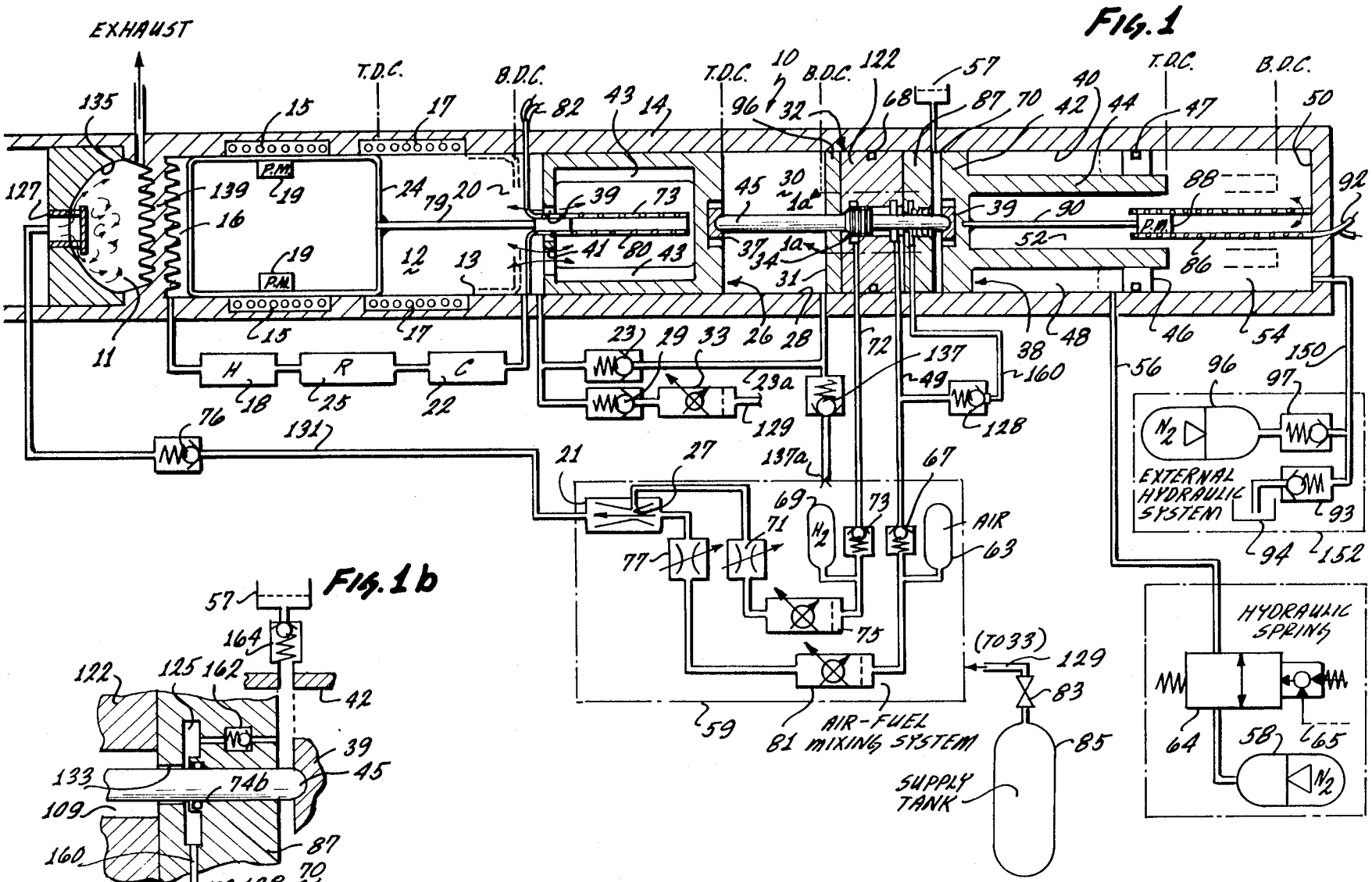
FIG. 1 is a cross section of a preferred embodiment of the invented engine showing in schematic form the hydraulic control system and working gas recovery system.
FIG. 1*b* shows in fragmentary section an alternate air intake structure for the pump arrangement of FIG. 1*a;*

The engine 10 of FIG. 1 is seen to comprise a displacer chamber 12 defined by a bore 13 in an engine housing 14 and filled with a working gas such as hydrogen gas under pressure, a displacer piston 24, a heater 18, a cooler 22 and a regenerator 25 connected between the heater and the cooler.

The displacer bore 13 has a hot end 16 connected to the heater 18 and a cold end 20 connected to the cooler 22. The regenerator 25 is connected between the heater and the cooler such that the working gas in chamber 12 is displaced through the heater 18 regenerator 24 cooler 22 assembly in response to reciprocating movement of the displacer 24 between the two ends of the displacer bore 13. Thus, by moving the displacer 24 from the hot end 16 to the cold end 20, the gas is displaced through the cooler into the regenerator where previously stored heat is returned to the hydrogen gas and then through the heater 18 where additional heat is added to the hydrogen as the heated gas reenters the chamber 12 at the hot end 16. A gas burner 11 is shown at the left end of the engine, although in practice such a burner would be part of the heater 18 which is shown as a separate block only for purposes of illustration.

The gas burner 11 is preferably of the radiant type and may comprise a cup of a suitable ceramic material which defines a concave radiant face 135. A fuel inlet 126 enters the burner cavity axially at the center of the cup for injecting pressurized gas into the burner cavity where it is combusted so as to heat the concave cup surface. The heated cup surfaces radiate thermal energy against the ribbed wall 139 which closes the hot end of the displacer chamber 12.

This heating of the hydrogen gas increases the pressure in the working gas chamber 12 which communicates with a work piston bore 28 where the heated working gas acts against a work piston 26, shown in top dead center position (TDC) in FIG. 1. Preferably, the work piston 26 is of hollow construction, apertured at 39 in its upper face and further apertured at 41 to permit free flow of gas from the working gas chamber 12 to the interior of the power piston. Heat exchange fins 43 may extend from the interior wall of the hollow work piston for facilitating dissipation of heat from the working gas through the walls of the work piston to the engine casing 14, thereby minimizing heat flow through the lower face 26 of the work piston towards the hydraulic end of the engine. The work piston reacts to the increased working gas pressure by moving towards the right in FIG. 1 against the combined resistance of a gas spring 30 and a liquid spring 48 to the bottom dead center (BDC) position suggested in dotted line at the right end of the gas spring space 30. The gas enclosed in the space 30 between the work piston 26 and partition 32, and which may be hydrogen pressurized to a pressure equal to the mean pressure of the hydrogen in the working gas chamber 12, operates as a gas spring continuously urging the work piston 26 towards its top dead center position at the left end of its stroke in FIG. 1. The working piston 26 is a free piston in that it is not mechanically connected or otherwise coupled to the displacer piston 24.

A hydraulic piston bore 40 is formed in the engine housing 14 and the work piston bore 28 may be in coaxial alignment with the two bores 28 and 40 being closed off from one another by a partition 32. The partition 32 is traversed by axial bores 74*a* and 74*b* through which extends a piston linkage rod 45 connecting the work piston 26 to a hydraulic piston 38 movable in the coaxial bore 40. The work piston 26 and the hydraulic piston 38 form a compound work piston which reciprocates as a unit within their respective bores in response to fluctuations in the working gas pressure. The hydraulic pistion 38 may include a head portion 42 having a diameter such as to effect sealing engagement with the hydraulic bore 40, and a hollow cylindrical extension 44 of reduced outer diameter relative to the diameter of the head portion 42. The hydraulic piston bore may be divided into two chambers by a ring 46, mounted within the bore 40 as by means of a static seal 47, which slidingly receives the extension 44 of the hydraulic piston 38. Thus, a first annular hydraulic chamber 48 is defined between the wall of the hydraulic bore 40 and the outer surface of the cylindrical extension 44, and a second hydraulic chamber 54 is formed which includes the hollow interior 52 of the hydraulic piston and the space between the ring 46 and the bottom end wall 50 of the hydraulic piston bore 40.

The two piston chambers 48 and 54 are sealed from each other and hydraulic fluid in both chambers is compressed simultaneously during the downstroke of the hydraulic piston 38. One of these chambers is selected to serve as a liquid spring chamber and may be filled with a compressible fluid, while the remaining chamber may be filled with system hydraulic fluid to be pumped during operation of the engine. In a presently preferred embodiment of the invention, the liquid spring comprises an incompressible fluid in the chamber 48 and a conduit 56 connecting the chamber 48 through a hydraulic control valve 64 to a pressure accumulator 58. The spring fluid under pressure urges both the hydraulic piston 38 and the power piston 26 connected through linkage rod 45 towards their top dead center position. The liquid spring 48 and the gas spring 30 thus cooperate to return the pistons 26 and 38 following the power stroke.

Desirably, the linkage rod 45 is connected to the working piston 26 and hydraulic piston 38 by means of universal joint couplings 37 and 39 respectively, so as to minimize transmission of lateral or radial forces from one piston to the other, thus minimizing the friction between the pistons and their respective bores. The linkage rod 45 is of relatively small diameter in comparison with the diameter of the work piston bore 28 or the hydraulic piston bore 40 and consequently substantially simplifies the sealing of the linkage bores 74*a* and 74*b* extending through the partition 32. The hydrogen gas in the spring chamber 30 can be sealed against leakage through the bore 74 more readily than would be the case if a seal were attempted between the larger diameter and circumference of either the working or hydraulic piston. The partition 32 may include a static seal 68 between its circumference and the engine housing 14, or it may be formed integrally with the engine housing 14. The linkage bore 74 with the connecting rod 45 extending therethrough may be sealed againt leakage of the hydrogen gas by means of one or more bushing or labyrinth seals. Any hydrogen gas leaking into the linkage bore 74 past such seals may be drawn off through a radial passage 72 defined in the partition 32 and fed back to the burner 11 where it can be disposed of by combustion. The top end of the hydraulic piston bore 40 may be an air space 70 vented to the atmosphere, preferably through filtered breather passage 57, and is therefore at atmospheric pressure. Thus, any hydraulic fluid from annular chamber 48 leaking around the hydraulic piston 38 enters the space 70 from which it can be drained without leaking into the gas spring space 30.

Figure 1A:
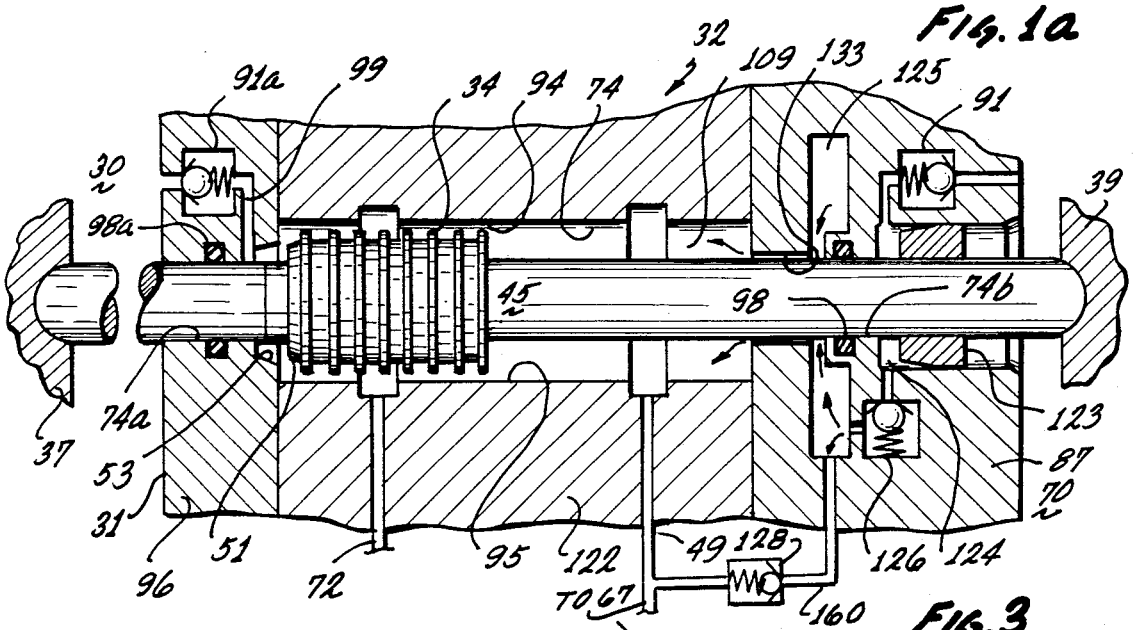
FIG. 1*a* is an enlarged view of the pump arrangement for compressing working gas from the displacer chamber and air drawn from the atmosphere to obtain a fuel mix for the engine burner.

For practical reasons the partition 32 may comprise three axially adjacent elements 96, 122, and 87 which are desirable in order to define a number of internal cavitites and passages in the pumping arrangement best shown in FIG. 1*a*. The partition 32 comprised of the three adjacent elements is traversed by a bore 74 through which extends the linkage rod 45 connecting the two pistons 26 and 38 of the compound work piston. The axial bore 74 includes two bearing surfaces 74*a* and 74*b* which support the linkage rod 45 for reciprocal motion. An inner generally cylindrical chamber 109 is defined intermediate the bearing surfaces by the partition element 122 and is sealed by mechanical seals 98 and 98*a* at the bearing surfaces 74*a* and 74*b*. The linkage rod 45 is provided with a number of axially spaced radial flanges which jointly form a labyrinth seal 34 in cooperation with the bore surface 95. The periphery of the seal flanges 34 does not make contact with the internal surface 95 of the chamber 109 so that a small gap 94 remains. Two radial passages 72 and 49 are defined within the partition element 122 and open into the chamber 109 at sufficiently axially spaced ports such that at least a portion of the labyrinth seal 34 separates the ports at all times, such that only a very small amount of gas flows across the labyrinth seal between the two ends of the chamber 109. As shown in FIG. 1*a*, the first passage 72 is substantially closed off from the pump chamber 109 by the labyrinth seal 34 when the connecting rod 45 is at its left most end of travel corresponding to top dead center of the compound work piston, while the passage 49 is open at that time. Similarly, the second passage 49 is closed off when the rod 45 is brought to its lower most end of travel, thereby opening passage 72. It is expected that some leakage of working gas will occur from the displacer chamber 12, around the work piston 26 and into the gas spring space 30. This leakage is compensated for by drawing working gas from the gas spring space through a passage 99 defined in the partition element 96. A check valve 91*a* is provided within the passage 99 so as to allow gas flow from the gas spring 30 into the upper or left end of chamber 109, but not the reverse. On the downstroke of the compound work piston the gas in the spring space 30 is compressed, opening the check valve 91*a*. The rate of flow of gas into the pump chamber 109 is largely determined by the aperture of the passage 99.

The bearing surface 74*a* is provided with dynamic seal 98*a* which substantially prevents leakage of gas from the gas spring 30 into the chamber 109. The partition element 96 may be further shaped to provide a frustro-conical seat 53 into which the upper tapered end 51 of the labyrinth seal 34 may seat so as to provide a positive static seal when the engine is in a stopped condition with the compound work piston in a selected position past top dead center to fully contain hydrogen gas leakage from the gas spring 30 into the chamber 109.

The lower or right end of the chamber 109 is in communication with an air storage chamber 125 through a restricted passage 133 defined between the linkage rod 45 and the partition element 87. The chamber 125 is a storage chamber from which a constant flow of air is allowed to escape through this restricted passage towards chamber 109 so as to maintain a positive pressure interface between gases in chamber 109 and chamber 125. This pressure interface helps to prevent working gas from leaking across the labyrinth seal 34 from escaping into the atmosphere. The continuous pressure interface is generated by compressing air into the storage chamber 125 by means of a piston 123 mounted on the connecting rod 45 and reciprocating within a bore 124 defined in the lower face of the partition element 87. When the connecting rod 45 travels to the right in FIG. 1*a*, the piston 123 is withdrawn from the bore 124 and moved into the air space 70 defined between the partition 32 and the top face of the hydraulic piston 42. Air is thus allowed to fill the bore 124 and when the connecting rod 45 returns to top dead center, the piston 123 re-enters the cavity 124 to compress the air therein. The compressed air passes through a check valve 126 into the storage chamber 125 from which it is allowed to leak through the restricted passage 133 towards the chamber 109. Since it is contemplated that the reciprocating action of the linkage rod 45 will occur at a rapid rate, the storage chamber 125 should be dimensioned so as to contain a sufficient supply of pressurized air for maintaining a positive pressure gradient in the passage 133. A second check valve 91 is provided in a passage connecting the inner end of the piston bore 124 to the air space 70. The check valve 92 is an anti-suction valve and permits atmospheric air to enter the piston chamber 124 to thereby equalize pressure on both sides of the piston 123 and break the vacuum which would be otherwise created by the outward movement of the piston 123. A mechanical seal 98 may be provided at the bearing surface 74*b* to contain the pressurized air in the storage chamber 125 against leakage into the piston chamber 124 through the linkage rod bore.

The linkage rod 45 and the cavities, passages and seal elements associated with the bore 74 constitute a pump arrangement for compressing hydrogen or other working gas drawn from the gas spring space 30 into the pump chamber 109. The hydrogen is fed through the hydrogen output line 72 to the exterior of the engine. The pump arrangement also compresses air into the air output line 49, through check valve 67 and into storage tank 63. The gases are maintained substantially separate during the pumping operation and each gas is boosted in pressure in a two stage operation.

The operation of the pump will now be described. Movement of the linkage rod 45 from left to right in FIG. 1*a* creates a relative vacuum at the left end of the chamber 109 which aids in opening the check valve 91*a* to draw hydrogen gas from the gas spring chamber 30 into the chamber 109. When the linkage rod returns on the upstroke from right to left, the check valve 91*a* closes and the labyrinth seal piston 34 compresses the drawn in hydrogen gas, which flows out of the chamber 109 through the line 72.

On the upstroke of the linkage rod, air is drawn into chamber 109 on the right hand side of the labyrinth seal 34 through line 49 from chamber 125. Said line 49 may be connected through check valve 128 and line 160 to the air storage chamber 125, as best seen in FIG. 1*a*.

In an alternate embodiment of the invention shown in FIG. 16, the cushioning piston 123 check valve 91 and chamber 124 may be omitted, such that air compressed by the hydraulic piston 38 in air space 70 is admitted into the storage chamber 125 through a suitable check valve such as 162, as shown in FIG. 1*b*. In this alternate embodiment it is necessary to provide a check valve 164 which may be placed between the filter or breather 57 and the air space 70 so as to allow inflow of air into the space 70 on the downstroke of the hydraulic piston but to check outflow of air on the upstroke, so that air from spce 70 is compressed into the chamber 125. The air in the chamber 125 then flows partly through the circumferential passage 133 to establish a pressure gradient seal against leakage of hydrogen from the piston chamber 109, and partly through conduit 160, check valve 128 and line 49 into pump chamber 109 where the air iis again compressed on the downstroke of the linkage rod and fed to the air-fuel mixing system 59 by line 49. It is intended that there be a close fit but no physical contact between the seal structure 34 and the inner surfaces 95 of the chamber 109 such that the passage 94 remains dimensionally constant and is not enlarged due to wear. Thus, any leakage between the left and right hand sides of the chamber 109 will be at a constant rate. While some mixing of air and hydrogen may thus occur through the restricted space 94, such leakage is of no major consequence since it is contemplated that in a preferred embodiment of the invention the hydrogen compressed by this pumping arrangement be eventually mixed with air and fed back to the burner of the engine.

The compressed hydrogen gas from the linkage bore 74 passes through a checkvalve 73 to a hydrogen storage tank 69. The tank 69 may be connected through a pressure control valve 75 and a needle valve 71 to a lateral opening 27 in the throat of a venturi passage 21. Air stored under pressure in the tank 63 is available through the pressure control valve 81 which is connected through a needle valve 77 to the inlet of the venturi 21. The air flow through the venturi 21 entrains hydrogen gas from the lateral throat orifice 27 such that admixture of the hydrogen with the air takes place at a rate determined by the settings of the needle valves 71, 77 and pressure regulators 75, 81. The resultant fuel mixture is available at the outlet of the venturi and directed by conduit 131 through an anti-flashback check valve 76 to the inlet 127 of the engine burner.

A further advantage of this working gas seal and recovery system is that the piston 123 reciprocating into the chamber 124 operates to cushion the compound work piston structure at the end of its upstroke. This cushioning effect takes place due to the compression of air by the piston 123 within the bore 124. As noted previously, the compressed air serves to define a pressure gradient which seals the hydrogen gas against escaping into the atmosphere and thus is put to a useful end. The combined mass of the hydraulic piston 38, the work piston 26 and the hydraulic fluid which is drawn into the engine on the upstroke of the compound work piston represents a considerable amount of inertia which must be absorbed to bring the compound work piston to a stop on its upstroke. In the absence of the cushioning effect of the piston 123, this inertia would have to be fully absorbed by operation of the hydraulic control valve 64 by restricting the in-flow of hydraulic fluid into the chamber 48 of the engine to thus stop the hydraulic piston. While this may be achieved, the hydraulic fluid and control valve 64 are heated as a result of the stopping of the pistons since the kinetic energy of the piston mass is transformed into heat when the piston is stopped. This heat would normally be wasted by heating the hydraulic fluid and the hydraulic control valve 64, which heat may be detrimental to the long term performance of the hydraulic control valve 64 and associated systems. It is therefore desirable to remove some of this load from the hydraulic control system by providing the cushioning seal structure of which the piston 123 forms a part. The hydraulic control system nevertheless performs the primary control over the movement of the pistons, the cushioning seal being only provided to absorb a residual energy at the very end of the piston upstroke.

A further advantage of the disclosed air-fuel mixing system is that the high cyclic rate of compression of air in the chamber 124 by the piston 123 generates a considerable amount of heat which may be put to a useful purpose for preheating both the compressed air in line 49 and the compressed hydrogen in line 72. The preheating may be accomplished by allowing the heat to diffuse from the storage chamber 125 and surrounding structures into the partition element 122 which may be of thermally conductive material, such as metal. The hydrogen and air are thus preheated in chamber 109 and conduits 72 and 49 prior to mixing and feeding back to the engine burner, which is conducive to more efficient combustion thus further improving the overall efficiency of the engine.

The compound work piston and associated working gas leakage control system thus performs a four-fold function: isolation of hydraulic fluid from the working gas spaces; solution of the problem of working gas leakage by mixing it with air and recirculating the mixture as fuel for the engine burner; cushioning the hydraulic piston 38 on its upstroke in order to reduce the thermal as well as mechanical load on the invented hydraulic piston motion control system; and using the heat generated by the cushioning action to preheat the hydrogen air fuel mixture.

If so desired, the working gas may be allowed to leak from the displacer chamber 12 past the work piston 26, into the gas spring 30 and then into the conduit 72 at a rate sufficient to constitute the primary fuel supply to the engine burner. In such an embodiment of the invention the working gas in the displacer chamber is also the fuel for the engine, thereby solving all problems of disposal of any leakage of such gas. The air fuel mixing system 59 enclosed in the dotted lined box is preferably comprised of components mounted externally to the engine casing 14 so as to be readily accessible for adjustment and maintenance.

The engine is initially charged by connecting a source of pressurized hydrogen gas to the check valve 137 at inlet **137*a* which allows gas to flow into the gas spring space 30 and also through the check valve 23 into the displacer chamber 12. The displacer chamber 12 and gas spring 30 are initially pressurized to a substantially equal pressure of compressed hydrogen. During operation of the engine, however, the pressure in the displacer chamber 12 fluctuates cyclically. The function of the check valve 23 therefore, is to contain the heated working gas in the displacer chamber 12 which would otherwise tend to flow through the connecting conduit 23*a* into the gas spring 30 so as to equalize pressure on both sides of the working piston 26**, which would naturally inhibit operation of the engine.

A hydrogen supply tank 85 may be connected through a valve 83, pressure regulator 129 and check valve 29 to the displacer chamber 12 to make up for hydrogen gas lost through leakage around the work piston 26 into the gas spring space 30 and into the pump chamber 109. The hydrogen tank 85 may be merely a hydrogen make-up tank for replenishing the displacer chamber for such leakage. If, as has been noted, the leakage into chamber 109 is permitted to be sufficiently large, the hydrogen tank 85 may constitute the primary fuel supply source such that the fuel is also the working fluid supplied to the displacer chamber 12 and allowed to leak through the gas spring space 30 into the pump chamber 109 and then to the outlet line 72, into the air fuel mixing system 59.

The work output of the engine of FIG. 1 may be taken from the chamber 54 through a hydraulic output conduit 150 which is connected to an external hydraulic system enclosed in the dotted line box 152. The external hydraulic system may comprise a source or tank 94 of hydraulic fluid connected through a check valve 93 to the output conduit 150 so that fluid is drawn from the tank 94 into the piston chamber 54 on the upstroke of the hydraulic piston 38. The hydraulic pressure output produced on the downstroke of the piston 38 is received in a pressure accumulator 96 connected through a second check valve 97 to the hydraulic output conduit 150. The pressurized fluid on the downstroke of the piston 38 is driven through the check valve 97 into the accumulator 96 where it may be stored for future use. It will be understood throughout the specification that accumulators need not be used for receiving the work output of the engine but rather the hydraulic output of the engine may be directly connected for driving some mechanism without provision for storage of the hydraulic output.

The annular spring chamber 48 may be connected by means of a conduit 56 to a hydraulic pressure accumulator 58 through a control valve 64 which controls both inflow and outflow of hydraulic fluid to the annular chamber 48. The valve 64 may be of the electromechanical type responsive to an electrical control signal applied to an input 65. In a preferred embodiment, the valve is infinitely variable between a fully open condition and a fully closed condition to thereby precisely control the rate of flow of spring fluid into and out of the annular chamber 48. The valve 64 enables the hydraulic piston 38 to be controlled because the spring fluid filling the annular piston chamber 48 and flowing through the conduit 56 may be selected to be substantially inelastic, the spring force being supplied by nitrogen (N2) gas compressed in the accumulator 58. Thus, when valve 64 is closed, the hydraulic piston 38 is locked in whatever position it happens to be in at the moment of closure since the inelasticity of the hydraulic fluid will not permit further movement. Similarly, by changing the aperture of the valve 64, the rate of flow of hydraulic fluid through the conduit 56 to or from the piston chamber 48 can be controlled and it is possible to dampen or slow by any desired amount the movement of the hydraulic piston both during the downstroke or the upstroke. It is also possible, however, to use a valve of the type which can only be switched between a fully open and fully closed condition. Such a valve would permit the piston to be stopped or locked by closure of the valve, but will not allow precise control over the rate of displacement of the piston by controlling the flow or fluid through the conduit 56.

The engine is provided with a pair of piston position sensors for continuously sensing the position of the displacer piston 24 and the compound work piston 26, 38. By way of example, the position sensors may be linear variable differential transformers, although other sensor means may be selected. A small permanent magnet 78 may be mounted to the displacer piston 24 by means of an axial rod 79 such that the permanent magnet 78 moves axially together with the displacer. A linear variable differential transformer (LVDT) winding 80 is wound in an axial direction and is affixed relative to the engine housing 14 such that the permanent magnet 78 is displaced axially within the LVDT transformer winding 80.

The work piston 26 may be of hollow construction and have a central opening 39 formed in its face 27. The linear variable differential transformer coil 80 may be mounted such that it is received axially in the interior of the work piston 26, when the work piston is at top dead center. A second opening 41 in the upper face of the work piston 26 allows free circulation of gas from the working gas chamber 12 into the interior of the work piston 26. A second position transducer may comprise a linear variable differential transformer winding 86 mounted to the end wall 50 of the hydraulic piston bore and a permanent magnet 88 mounted to the hydraulic piston 38 by means of axial rod 90. The LVDT sensor windings 80 and 86 can be excited by an alternating current in a manner known in the art to derive an output indicative of the position of the respective permanent magnets 78, 88 along the axis of the transformer windings 80, 86, this in turn being indicative of the position of the displacer and hydraulic pistons within their respective bores. Electrical conductors 82 and 92 are connected to the transformer windings 80, 86 respectively and may extend through the engine housing 14 to the exterior for connection to an engine controller.

As previously described, a pair of spaced apart, series connected, drive coils 15 and 17 may be wound coaxially with the displacer bore 13, and one or more permanent magnets 19 may be mounted to the displacer cylinder 24. Current may be passed through the displacer drive coils 15 and 17 to establish a variable magnetic field within the displacer bore so as to reciprocate the displacer piston 24 with the permanent magnets 19 within the displacer bore 13. The thermodynamic cycling of the working gas can therefore be externally controlled by the selective actuation of the drive electromagnets 15 and 17. The movement of the displacer piston 24 is completely controllable by means of the electromagnet coils and by adjusting the current through the coils, the frequency of oscillation, as well as the speed of movement thereof can be completely determined. Further, the displacer can be arbitrarily accelerated in any desired way during each stroke so as to obtain any desired heat transfer function to and from the working gas as it is circulated through the heater-regenerator-cooler assembly.

Such movement of the displacer piston 24 causes a cyclic pressurization of the working gas in the working gas chamber 12 which pressure acts against the work piston 26 and pushes the work piston towards the bottom wall 31 of the work piston bore 28, against the pressure of the gas spring 30. The hydraulic piston 38 follows the movement of the work piston to produce a hydraulic pressure output through conduit 150 connected to the chamber 54, and to compress spring fluid from annular chamber 48 through conduit 56 and control valve 64 into the hydraulic spring pressure accumulator 58.

For a given movement of the displacer piston 24 with the control valve 64 in fully open condition, the work piston and the hydraulic pressure output will follow some work output function peculiar to the particular engine construction. The natural stroke of the work piston responsive to any given movement of the displacer piston 24 can be modified by adjustment of the aperture of the valve 64 in the hydraulic spring conduit 56. For example, the work piston 26 may be locked at top dead center position, that is, at the extreme left of its stroke in FIG. 1, while the displacer 24 is moved from top dead center to bottom dead center of its stroke, i.e., left to right in FIG. 1. This is represented in the PV diagram of FIG. 2 as the constant volume portion of the cycle represented by movement from point II to point III. At point III the displacer piston 24 may be held at bottom dead center by, for example, passing a steady current of appropriate polarity through the drive coils 15, 17 and the hydraulic valve 64 may then be opened to release the work piston 26 from TDC and thus allow expansion of the heated working gas in chamber 12. As a result, the work piston is pushed to bottom dead center, as represented by the curve from point III to point IV of the PV diagram. This is the power stroke of the work piston 26 which produces a hydraulic pressure output through conduit 150 by means of the hydraulic piston 38. Following completion of the power stroke, the hydraulic valve 64 may be again closed to lock the work piston in bottom dead center position and the electromagnets 15 and 17 can then be activated to bring the displacer piston 24 to its top dead center position at the hot end 16 of the displacer bore 13. This is represented by the constant volume portion of the cycle from point IV to point I. The engine cycle is then completed by opening the hydraulic valve 64 to permit the work piston 26 to return to its top dead center position in response to the urging of the gas spring 30 and hydraulic spring 48 acting against the reduced pressure of the cooled working gas in the displacer chamber 12. In this manner, a Stirling cycle approximating the curve of FIG. 2 can be achieved in a practical engine.

Figure 2:
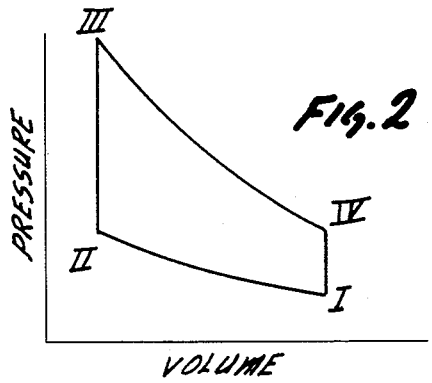
FIG. 2 is a typical pressure-volume diagram of a Stirling thermodynamic cycle.
Figure 3:
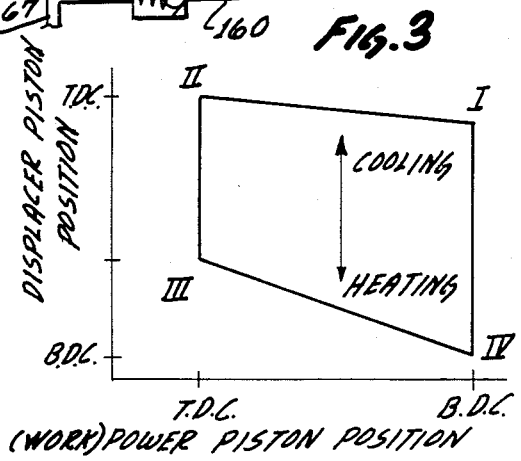
FIG. 3 is a piston position diagram for a practical Stirling engine corresponding to the Stirling cycle of FIG. 2.

As has been previously described in connection with the statement of the prior art, an ideal Stirling cycle in a practical engine does not exactly correspond to the four-step piston movement just described in connection with the PV diagram of FIG. 2. Instead, a piston movement as illustrated in FIG. 3 more closely approaches an ideal Stirling cycle in a practical engine, for the reasons set out in the summary of the prior art and in the referenced article incorporated into this disclosure. Such piston movement can be obtained in the present engine because the movement of both displacer piston and work piston are controllable independently from one another according to an arbitrary, externally imposed cycle.

Figure 4:
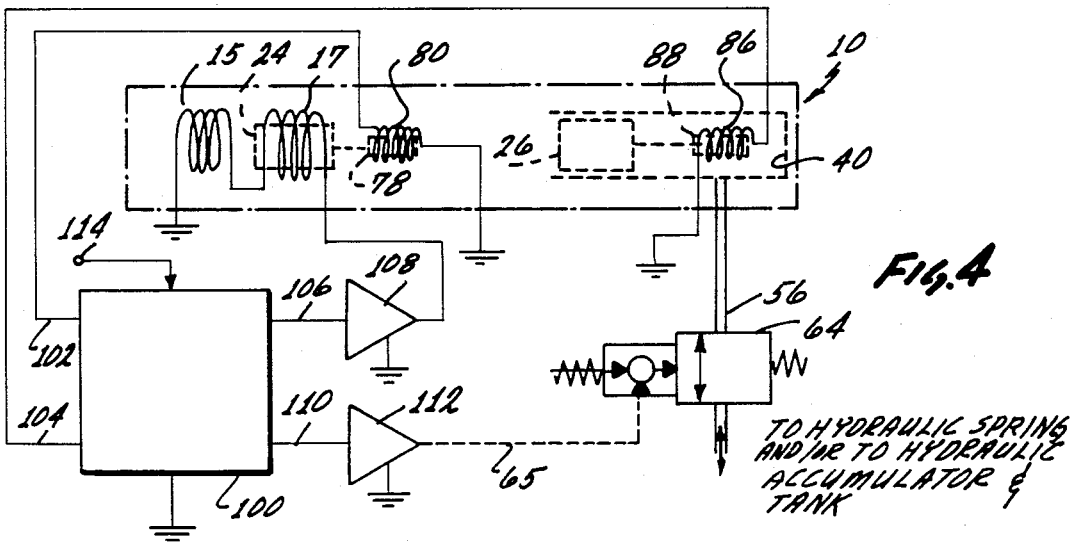
FIG. 4 is a block diagram of a piston motion control system for the engine of FIG. 1.

In a preferred embodiment, a selected engine operating cycle is obtained through an engine controller which receives as an input the signals produced by the piston position sensor coils 80 and 86 to generate a control output connected for controlling the hydraulic control valve 64 and the displacer drive coils 15, 17. With reference to FIG. 4, a typical control system for the invented engine may comprise a controller 100 which may be a programmable controller and receives as inputs 102, 104 the output signal of the displacer and work piston sensors 80, 86 respectively. The controller 100 generates a first output 106 connected through servo-amplifier 108 for driving the displacer coils 15, 17, and a second output 110 connected through a second servo-amplifier 112 for operating the hydraulic control valve 64. The displacer position sensor coil 80 may be the master transducer in the system and produce the primary reference input to the controller, while the work piston sensor coil 86 may be the slave transducer such that its input is an error signal which closes the servo-control loop.

It will be understood that the mounting and configuration of the position sensor coils 80 and 86 are shown only by way of example. Different methods of mounting the position sensors may be resorted to, as well as using position sensors other than linear variable differential transformers. The object of the sensors is to derive an output indicative of the position of the displacer and work piston as inputs to a controller device which in response to these inputs produces an output for controlling the movement of the displacer and work pistons through the electromagnet coils 15, 17 and the control valve 64, respectively. The controller device may be an electronic servo-controller such as are presently known, and may be a programmable controller which may be programmed to operate the engine of this invention according to a programmed engine cycle.

It is specifically contemplated that a programmable digital computer may be employed to control the engine of this invention and may have stored in its memory one or more engine operating cycles which may be selected at will. The controller 100 may, for example, receive a further input 114 from a pressure sensor (not shown) mounted for sensing the output pressure of the system hydraulic fluid in line 150 or in output accumulator 96, and respond to this output pressure information by operating the displacer and work pistons to maintain a constant output pressure during variable load conditions on the engine. The controller 100 may be thus actuated to optimize the system's efficiency for given torque or speed requirements on the engine. For example, a shaft driven by the hydraulic output of the engine through a suitable hydraulic drive may be operated at a constant speed under variable loads imposed on the shaft by adjusting the engine cycle, i.e., the piston movements of the engine. A constant torque output requirement may also be met by controlling the engine cycle. Thus in certain applications it may be possible to eliminate mechanical or other transmission systems designed to match the engine output to a variable load.

The controller 100 may further maintain a given output requirement under variable heat input conditions to the heater of the engine. For example, in solar energy installations the solar energy available varies through the day and through the year and despite energy storage systems it may be impractical to maintain a constant heat input to the engine. Temperature sensors may be included in the controller system for sensing the heat differential between the hot end and the cold end of the displacer chamber at any given time and to adjust the piston movements accordingly to satisfy some output requirement. The basic requirement for the operation of the controller device is that it maintain the engine pistons in proper relationship according to a desired engine cycle. Towards this end the instantaneous position of the displacer and work pistons are monitored by the sensor coils 80 and 86, and the output information derived is fed as an input to the controller 100. The controller then derives a current output to the displacer coils 15 and 17 and a control output to the hydraulic valve 64 for controlling the work piston 26. With reference to the piston position diagram of FIG. 3, it will be understood that the movement of the pistons is not limited to the linear functions shown. For certain engine cycles it maybe desirable to accelerate either or both of the displacer and work pistons during their strokes such that the piston movements in the piston position diagram of FIG. 3 would be represented by curved lines instead of the straight lines shown. Arbitrary acceleration and deceleration of the pistons is possible under complete control of a suitably constructed engine controller 100.

The invented engine is not limited to operation as a Stirling engine, although this is the presently preferred operating cycle. By controlling the movement of the displacer piston and the work piston, other engine cycles, such as the Ericsson cycle, may be obtained in the engine of this invention.

Figure 5:
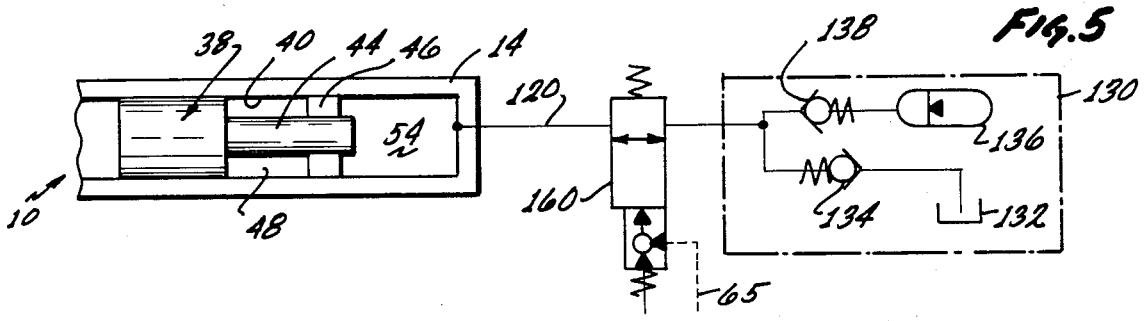
FIG. 5 is a first alternate arrangement of the hydraulic output and work piston control system for the engine of FIG. 1.

The hydraulic output and control arrangement of the engine of FIG. 1 may also take one of the several alternate forms shown in FIGS. 5 through 9. In FIG. 5 the hydraulic output of the engine 10 (shown in part only but similar to the engine of FIG. 1 as to the portions not shown) is taken from the hydraulic chamber 54 previously described in connection with FIG. 1. The chamber 54 is pressurized by the cylindrical extension 44 of the hydraulic piston 38 and is sealed off from the annular chamber 48 by the annular partition 46. It is understood that the hydraulic piston 38 may be linked to a work piston 26, shown only in FIG. 1, to form a compound work piston. The hydraulic work output is taken from the chamber 54 through a hydraulic output line 120 connected to the external hydraulic system enclosed in the box in dotted lines and generally numbered 130. A hydraulic control valve 160, equivalent to the control valve 64 in FIG. 1 and provided with a control input 65, may be operated to control the flow of hydraulic fluid through the output conduit 120, thereby to control the movement of the hydraulic piston 38 and connected work piston 26. The external hydraulic system may comprise a tank 132 which is a source of hydraulic fluid connected to the hydraulic output line 120 through a check valve 134, which prevents hydraulic fluid from returning to the tank. The hydraulic system 130 may also comprise a hydraulic pressure accumulator 136 connected through a check valve 138 to the hydraulic output line 120, the check valve serving to prevent pressurized fluid in the accumulator from returning to the engine. The annular chamber 48 serves as the liquid spring for returning the compound work piston to its top dead center position. In this alternate embodiment a compressible spring fluid is used to fill the spring chamber 48 and consequently the pressure accumulator 58 of FIG. 1 is not required.

Figure 6:
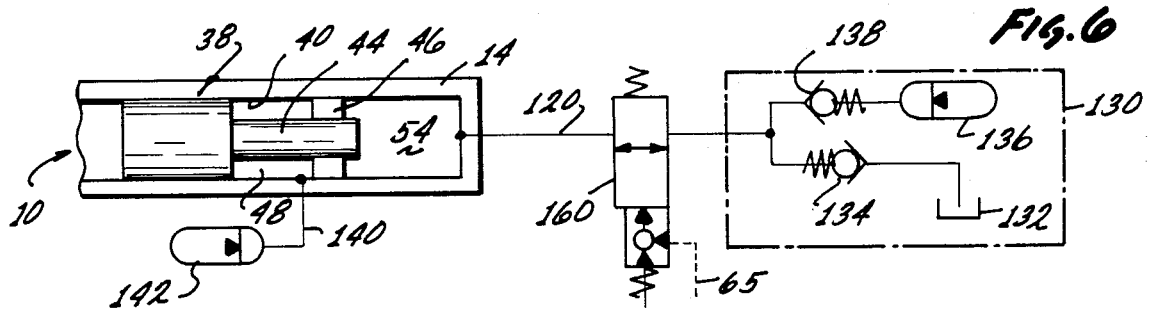
FIG. 6 is a second alternate output and work piston control arrangement for the engine of FIG. 1.

In the embodiment of FIG. 6 the annular chamber 48 is filled with a substantially incompressible hydraulic fluid which is connected through a line 140 to a hydraulic pressure accumulator 142. Thus, on each down stroke of the work piston, hydraulic fluid from the spring chamber 48 is compressed into the accumulator 142 and returns the work piston after the working fluid in chamber 12 has been cooled and its pressure is no longer sufficient to oppose the pressure of the spring fluid in accumulator 142. A hydraulic control valve 160 is connected in line with the hydraulic work output conduit 120 for controlling the flow of hydraulic fluid into and out of the bottom chamber 54 of the engine, to and from the external hydraulic system 130. As described previously in connection with FIGS. 1 through 4, the control valve 160 is under the control of an engine controller for controlling the movement of the work piston.

Figure 7:
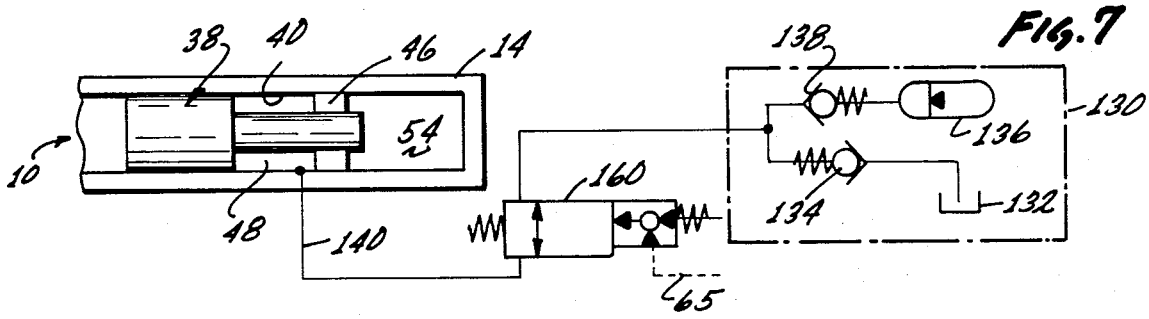
FIG. 7 is a third alternate output and work piston control arrangement for the engine of FIG. 1.

In the alternate embodiment of FIG. 7, the hydraulic work output is taken from the annular chamber 48 by means of an output conduit 140 which is connected to a hydraulic system 130 similar to that described in connection with FIG. 5 and FIG. 6. A hydraulic control valve 160 is connected for controlling the flow of hydraulic fluid through the conduit 140, thus to control the motion of the hydraulic piston 38. The chamber 54 may be filled with a compressible fluid for returning the hydraulic piston.

Figure 8:
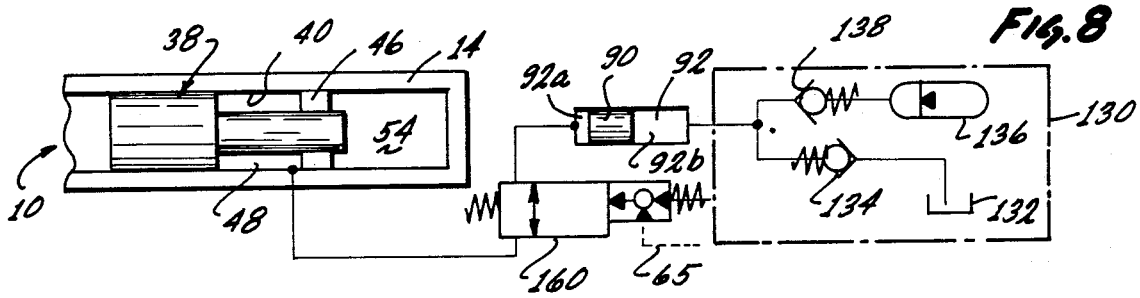
FIG. 8 is a fourth alternate output and work piston control arrangement for the engine of FIG. 1.

In the alternate embodiment of FIG. 8, the control valve 160 is protected against contaminated hydraulic fluid by an intermediate isolation free piston 90 movable in a piston cylinder 92. The annular chamber 48 can be filled with a clean, high quality hydraulic fluid which is pumped through the control valve 160. The control valve 160 is connected between the chamber 48 and the top end 92*a* of piston cylinder 92, such that the hydraulic output of the engine drives the free piston 90. The piston 90 in turn works against the external hydraulic fluid filling the bottom side 92*b* of the piston cylinder 92. The external hydraulic system 130 may also include a tank 132 supplying hydraulic fluid to the piston cylinder 92 through check valve 134, and an accumulator 136 receiving the effluent from the cylinder 92 through a check valve 138. The two hydraulic systems are thus isolated from each other by the free piston 90, such that the fluid in the engine control system may be kept clean, while the external system 130 may pump contaminated fluid. The chamber 54 may be filled with a compressible hydraulic fluid which operates as a spring to return the hydraulic piston 38 to top dead center.

Figure 9:
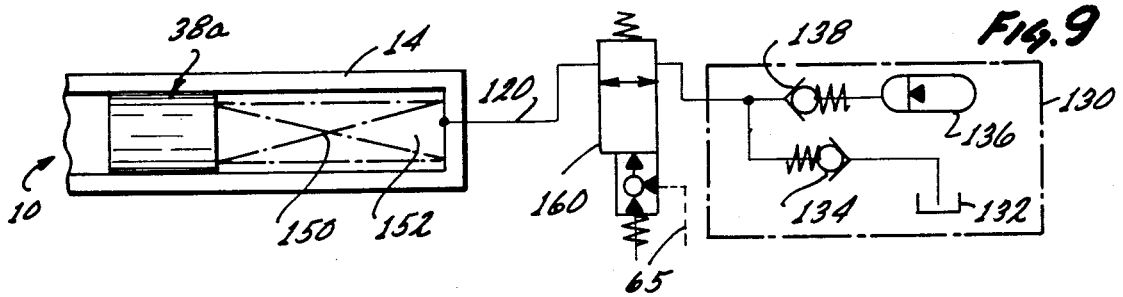
FIG. 9 is a fifth alternate output and work piston control arrangement for the engine of FIG. 1.

In the alternate embodiment of FIG. 9, the liquid spring has been eliminated and replaced by a mechanical spring 150 which serves to return the hydraulic piston 38*a* to its top dead center position. The hydraulic piston then works against hydraulic fluid in a single hydraulic piston chamber 152 from which a hydraulic work output is taken through line 120. The movement of the piston, which may be a compound work piston as in FIG. 7, is controlled by restricting the flow of hydraulic fluid through the hydraulic output conduit 120 by means of a hydraulic control valve 160 of the type described in connection with the previous embodiments.

As can be seen, many embodiments of the invented control system are possible in which the work piston is controlled by controlling the flow of a fluid pumped by the work piston. The pumped fluid may be either the hydraulic output of the engine or a spring fluid for returning the work piston to its top dead center position following its down stroke.

While several embodiments of the invention have been shown and described, it will be understood that yet other changes, modifications and substitutions may be made without departing from the spirit and scope of the invention. The applicant therefore intends to be bound only by the following claims.

What is claimed is:

1. A thermal engine comprising:

an engine housing;

a chamber defined within said housing;

a displacer piston within said chamber;

first means for reciprocating said displacer piston;

a working fluid within said chamber susceptible to a thermodynamic cycle responsively to movement of said displacer piston;

a work piston reciprocably driven by said working fluid;

second means for controlling the movement of said work piston relative to said displacer piston independently from said means for reciprocating said displacer piston; and engine controller means connected to said first and second means for controlling the phase relationship between said displacer piston and said work piston to thereby produce a desired engine cycle.

2. The engine of claim 1 wherein said second means comprise means for slowing or substantially locking said work piston against movement during selected portions of the displacer movement.

3. The engine of claim 1 or claim 2 wherein said second means comprises valve means for controlling the flow of a fluid pumped by said work piston to thereby slow or stop said work piston.

4. The engine of claim 1 wherein said second means comprise liquid spring means compressed by said work piston and valve means associated with said liquid spring means for slowing or stopping said work piston.

5. The engine of claim 1 wherein said work piston works against a hydraulic fluid to produce an output of hydraulic fluid and further comprising:

a source of hydraulic fluid connected for supplying fluid to said work piston; and an accumulator connected for receiving said hydraulic output;

said second means comprising valve means connected for restricting one or both of said supply and said output of hydraulic fluid to thereby control the motion of said work piston.

6. The engine of claim 1 or claim 3 further comprising:

sensor means for deriving a first input indicative of the position of said displacer piston and a second input indicative of the position of said work piston;

said engine controller means receiving said first and second inputs and deriving a first output connected for controlling said second means in predetermined relationship to said inputs.

7. The engine of claim 6 wherein said engine controller also derives a second output connected for controlling said first means in predetermined relationship to said inputs.

8. The engine of claim 1 wherein said first means comprise electromagnetic, hydraulic or pneumatic means connected for moving said displacer piston under control of said engine controller means.

9. The engine of claim 5 further comprising isolation piston means driven by a first hydraulic fluid pumped by said work piston through said hydraulic control valve means, said isolation piston pumping a second hydraulic fluid external to the engine such that said first hydraulic fluid flowing through said control valve means is isolated from possible contamination by said second hydraulic fluid to avoid damaging said valve means.

10. A thermal engine comprising:

an engine housing;

a chamber defined within said housing;

a displacer piston reciprocable within said chamber;

a working fluid within said chamber susceptible to a thermodynamic cycle responsively to movement of said displacer piston;

a first piston bore defined in said housing;

a work piston reciprocably driven by said working fluid within said first bore;

a hydraulic piston reciprocable for pumping an output fluid in a second piston bore defined in said housing;

partition means defining a linkage bore between said first and second piston bores;

linkage rod means extending through said linkage bore and transmitting the reciprocating movement of said work piston to said hydraulic piston, said linkage bore being of reduced diameter relative to either of said piston bores to thus facilitate sealing of said working and output fluids against leakage from their respective piston bores.

11. The engine of claim 10 further comprising a labyrinth seal between said partition means and said linkage rod means for sealing said linkage bore against leakage of fluid therethrough.

12. The engine of claim 10 further comprising at least one bushing seal between said partition means and said linkage rod for sealing said linkage bore against leakage of fluid therethrough.

13. The engine of claim 10 wherein the space in said second piston bore between said hydraulic piston and said partition means is vented to the atmosphere.

14. The engine of claim 10 or claim 13 wherein the space in said first piston bore between said work piston and said partition means encloses a spring fluid for returning said work piston following its power stroke.

15. The engine of claim 14 wherein said enclosed spring fluid is the same fluid as said working fluid.

16. The engine of claim 10 further comprising a combustor chamber for heating said working fluid; and a conduit connecting said linkage bore to said combustor chamber for disposing of working fluid leaking into said linkage bore by combustion in said combustor chamber.

17. The engine of claim 16 further comprising a check valve connected in said conduit for preventing flashback from said combustor chamber to said linkage bore.

18. The engine of claim 10 wherein said linkage bore is vented to the atmosphere.

19. The engine of claim 16 further comprising mixer means for admixing a second fluid to said working fluid leaking into said linkage bore to thereby obtain an improved fuel mixture prior to returning said leaking gas to said combustor chamber for ignition therein.

20. In a thermal engine of the type having a displacer piston reciprocable within a displacer chamber, an engine burner, a working fluid within said chamber susceptible to a thermodynamic cycle responsively to movement of said displacer piston and a working piston driven by said working fluid, an improved compound work piston comprising:

a first work piston element reciprocable in a first bore and driven by said working fluid;

a second work piston element reciprocable in a second bore for pumping a hydraulic fluid;

means defining a passage between said first and second bores, said passage being of restricted aperture relative to the diameter of either of said first or second bores;

linkage means extending through said passage for transmitting the reciprocating movement of said first work piston element to said second work piston element; and dynamic seal means for substantially sealing said passage against leakage of said working fluid therethrough into said second bore.

21. The engine of claim 20 wherein said defining means comprise the bottom wall of said first bore and the top wall of said second bore and wherein the space between said first work piston element and said bottom wall of said first bore is a fluid spring for urging said first work piston element to top dead center position.

22. The engine of claim 21 wherein said spring fluid is the same as said working fluid.

23. The engine of any of claims 20 through 22 wherein the space in said second bore between said defining means and said second work piston element is vented to the atmosphere.

24. The engine of claim 22 further comprising means for drawing fluid from said fluid spring space into said passage so as to remove working fluid leaking from said displacer chamber around said work piston into said spring space;

pump means for compressing the drawn fluid; and conduit means for carrying said compressed fluid away from said passage so as to contain such fluid against leakage into the atmosphere or into said second bore.

25. The engine of claim 24 further comprising conduit means for returning said compressed fluid to said engine burner for disposal by combustion therein.

26. The engine of claim 25 wherein said pump means also compresses atmospheric air and further comprising means for admixing said air to said compressed fluid prior to returning to said engine burner.

27. The engine of claim 25 or claim 26 wherein said compressed fluid is the primary fuel supply to said engine burner.

28. The engine of claim 20 wherein said first and second bores are coaxial, said defining means comprises a partition separating said first and second bore, said passage is an axial linkage bore extending through said partition and said linkage means is a linkage rod extending through said linkage bore, and a spring space defined between said first work piston element and said partition.

29. The engine of claim 28 wherein said linkage bore comprises a pump chamber including first intake means communicating with said first bore and said linkage rod is provided with pump means reciprocable within said pump chamber for drawing fluid from said spring space during one stroke of said linkage rod, said pump portions operating during the return stroke of said rod to compress said drawn fluid into a fluid output conduit.

30. The engine of claim 29 wherein said linkage rod pump means divide said chamber into first and second spaces, one of said spaces being associated with said first intake means and further comprising second intake means for drawing air from the exterior of said engine during said return stroke into the other one of said first or second spaces, said air being compressed during said one stroke into an air output conduit.

31. The engine of claim 30 wherein said second intake means further comprise piston means for maintaining a positive air pressure interface into said pump chamber to thereby further contain said fluid against leakage through said linkage bore.

32. The engine of claim 30 further comprising an air-fluid mixing system for admixing said compressed fluid with air and conduit means for feeding back said mixture for combustion in the engine burner.

33. A thermal engine comprising:
an engine housing;
a chamber defined within said housing;
a displacer piston within said chamber;
means for reciprocating said displacer piston;
a working fluid within said chamber susceptible to a thermodynamic cycle responsively to movement of said displacer piston;
a work piston reciprocably driven by said working fluid; and
means for locking said working piston against movement during selected portions of of the displacer movement independently from said means for reciprocating said displacer piston.

34. A thermal engine comprising:
an engine housing;
a chamber defined within said housing;
a displacer piston within said chamber;
means for reciprocating said displacer piston;
a working fluid within said chamber susceptible to a thermodynamic cycle responsively to movement of said displacer piston;
a work piston reciprocably driven by said working fluid; and
liquid spring means compressed by said working piston and valve means associated with said liquid spring means for slowing or stopping said working piston relative to said displacer piston independently from said means for reciprocating said displacer piston.

35. A thermal engine comprising:
an engine housing;
a chamber defined within said housing;
a displacer piston within said chamber;
means for reciprocating said displacer piston;
a working fluid within said chamber susceptible to a thermodynamic cycle responsively to movement of said displacer piston;
a work piston reciprocably driven by said working fluid;
said working piston working against a hydraulic fluid to produce an output of hydraulic fluid;
a source of hydraulic fluid connected for supplying fluid to said piston;
an accumulator connected for receiving said hydraulic output;
valve means connected for restricting one or both of said supply and said output of hydraulic fluid to thereby control the motion of said working piston relative to said displacer piston;
sensor means for deriving a first input indicative of the position of said displacer piston and a second input indicative of the position of said working piston; and
engine controller means receiving said first and second inputs and deriving an output connected for controlling said valve means in predetermined relationship to said inputs.

36. The engine of claim 34 or claim 35 further comprising displacer control means for controlling the reciprocating movement of said displacer body independently of said valve member.

37. The engine of claim 36 wherein said displacer control means comprise electromagnetic, hydraulic or pneumatic means connected for moving said displacer piston under control of said engine controller means.

38. A thermal engine comprising:
an engine housing, a chamber defined within said housing, a displacer piston within said chamber, displacer drive means for reciprocating said displacer piston, a working fluid within said chamber susceptible to a thermodynamic cycle responsively to movement of said displacer piston, a work piston reciprocably driven by said working fluid for pumping a liquid, valve means for controlling the flow of said liquid so as to control the movement of the work piston, and engine controller means connected to said displacer drive means and said valve means for controlling the phase relationship between said displacer piston and said work piston to thereby produce one or more selected engine operating cycles.

39. The thermal engine of claim 38 wherein said engine controller means are programmable for producing one or more particular engine cycles.

40. The thermal engine of claim 38 further comprising position sensing means for deriving a first input to said engine controller means, said first input being indicative of the position of said work piston.

41. The thermal engine of claim 40 further comprising position sensing means for deriving a second input indicative of the position of said displacer piston, said engine controller means receiving said first and second inputs for deriving an output connected for controlling said valve means and said displacer drive means in predetermined relationship to said first and second inputs.

42. The thermal engine of claim 38 wherein said displacer drive means comprise pneumatic means for reciprocating said displacer piston.

43. The thermal engine of claim 38 wherein said displacer drive means comprise electromagnetic means for reciprocating said displacer piston.

44. The thermal engine of claim 38 wherein said displacer drive means comprise hydraulic means for reciprocating said displacer piston.

45. The thermal engine of claim 38 wherein said displacer drive means comprise mechanical means for reciprocating said displacer piston.

* * * * *